United States Patent [19]

Kondo et al.

[11] Patent Number: 4,769,304

[45] Date of Patent: Sep. 6, 1988

[54] PHOTOCONDUCTIVE COMPOSITION AND ELECTRO-PHOTOGRAPHIC LIGHT-SENSITIVE MATERIAL USING SAID COMPOSITION

[75] Inventors: Shunichi Kondo; Kenji Sano; Hideo Sato, all of Saitama, Japan

[73] Assignee: Fuji Photo Film Co., Ltd., Kanagawa, Japan

[21] Appl. No.: 372,272

[22] Filed: Apr. 27, 1982

[30] Foreign Application Priority Data

Apr. 27, 1981 [JP] Japan ..... 56-63699

[51] Int. Cl.[4] ..... G03G 5/087

[52] U.S. Cl. ..... 430/96; 430/56; 430/84; 528/308.7

[58] Field of Search ..... 430/96, 84, 56; 528/308.7

[56] References Cited

U.S. PATENT DOCUMENTS

| | | | |
|---|---|---|---|
| 3,296,024 | 1/1967 | Jordan et al. | 528/308.7 X |
| 3,595,650 | 7/1971 | Holzinger et al. | 430/69 |
| 3,736,134 | 5/1973 | Gosselink et al. | 430/84 X |
| 3,837,851 | 9/1974 | Shattuck et al. | 430/59 |
| 4,006,017 | 2/1977 | Williams et al. | 430/79 |
| 4,018,607 | 4/1977 | Contois | 430/73 |

FOREIGN PATENT DOCUMENTS 024635 2/1979 Japan .

*Primary Examiner*—J. David Welsh

*Attorney, Agent, or Firm*—Sughrue, Mion, Zinn, Macpeak & Seas

[57] ABSTRACT

A photoconductive composition and an electrophotographic light-sensitive material using the photoconductive composition are described. The photoconductive composition comprises a photoconductive substance and a water-insoluble linear polyester copolymer wherein the polyester copolymer contains a constituent repeating unit derived from terephthalic acid and a straight $\alpha,\omega$-diol component, and the diol component contains at least three compounds selected from the group of ethylene glycol, diethylene glycol, triethylene glycol, 1,3-propanediol, 1,4-butanediol, 1,5-pentanediol, and 1,6-hexanediol. The electrophotographic light-sensitive material comprises a support and a layer of the above photoconductive composition on the support.

12 Claims, No Drawings

PHOTOCONDUCTIVE COMPOSITION AND ELECTRO-PHOTOGRAPHIC LIGHT-SENSITIVE MATERIAL USING SAID COMPOSITION

FIELD OF THE INVENTION

The present invention relates to a photoconductive electrically insulative (hereinafter referred to merely as "photoconductive") composition and an electrophotographic light-sensitive material formed using the composition, more particularly, to a photoconductive composition containing a linear polyester copolymer having improved polymer properties, and an electrophotographic light-sensitive material prepared using such a composition which has improved film properties.

BACKGROUND OF THE INVENTION

An electrophotographic light-sensitive material generally comprises a support in which at least the surface is electrically conductive, and at least one layer of a photoconductive composition on the support. In some cases an intermediate layer composed of a polymeric substance is provided between the electrically conductive surface of the support and the photoconductive composition layer to improve adhesion and/or as a barrier layer. Polymeric substances which can be used for the intermediate layer are described, for example, U.S. Pat. Nos. 3,640,708, 3,438,773, 3,745,005 and 3,932,179.

Polymeric substances for use in the intermediate layer are, as described in the above references, addition polymerization type hydrophobic/water-insoluble copolymers, such as terpolymers and tetrapolymers, containing a constituent repeating unit derived from a carboxylic group, e.g., carboxylic group of itaconic acid or acrylic acid, and/or a constituent repeating unit derived from vinylidene chloride. The term "constituent repeating unit" is used herein according to the definition described in *Kobunshi* (*High Polymers*), Vol. 27, pp. 345 to 359 (1978) (Japanese version of *Pure and Applied Chemistry*, Vol. 48, pp. 373 to 385 (1976).

It has been found that while good adhesion between the electrically conductive surface of the support and the photoconductive composition layer can be attained by using such hydrophobic/water-insoluble terpolymers or tetrapolymers in the intermediate layer they exert serious adverse effects on the electrical and photoconductive properties of the photoconductive composition layer. In particular such terpolymers or tetrapolymers containing an acid component (e.g., itaconic acid or acrylic acid) or a constituent repeating unit derived from vinylidene chloride which is liable to release hydrogen chloride on decomposition seriously deteriorate electrical properties.

U.S. Pat. Nos. 3,647,432, 3,765,884, etc., disclose compositions comprising organic photoconductive compounds or sensitizers and various binder substances. There are many useful binder substances, including polycondensation polymers (polyesters) of ethylene glycol or neopentyl glycol and terephthalic acid or isophthalic acid. It has been found, however, that although the polyester can be used as a binder substance for a photoconductive composition, when it is present as a single binder component for an organic photoconductive composition it happens to degrade the electrical properties of the photoconductive composition, making it impossible to easily receive an initial electrostatic charge (i.e., 600 volts or more) within the preferred handling range of the photoconductive composition.

Japanese Patent Application (OPI) No. 153741/77 (the term "OPI" is used herein to refer to a "published unexamined patent application") discloses the use of amorphous, water-insoluble and non-linear polyesters or copolyesters as binders for a photoconductive composition layer of a multi-layer composite photoconductive element (electrophotographic material) comprising a support having an electrically conductive layer and the photoconductive composition layer on the support which are electrically in contact with each other, or for the preparation of an intermediate layer which is, if necessary, provided between the support (electrically conductive layer) and the photoconductive composition layer. This electrophotographic light-sensitive material has the features that the electrical and electrophotographic properties of the photoconductive composition layer are superior, adhesion between the photoconductive composition layer and the electrically conductive layer of the support or intermediate layer is good and the film properties of the photoconductive composition layer are good.

As a result of extensive studies on the electrophotographic light-sensitive material disclosed in Japanese Patent Application (OPI) No. 153741/77—as that material has good electrophotographic properties and the photoconductive composition thereof has good electrophotographic, electrical and film properties—it has been surprisingly found in accordance with the present invention that a photoconductive composition having excellent electrical, electrophotographic and film properties can be prepared using inexpensive and relatively low molecular weight linear copolyesters which have heretofore been believed unsuitable for use as reinforcing agents or binders for photoconductive compositions for the reasons that they have low solubility in general solvents, high crystallizability and have poor adhesive force to other substances. It has further been found that an electrophotographic light-sensitive material with a photoconductive composition layer prepared using the above photoconductive composition has excellent electrophotographic properties.

SUMMARY OF THE INVENTION

One object of the present invention is to provide a photoconductive composition having excellent electrical properties and an electrophotographic light-sensitive material having excellent electrical and electrophotographic properties which is prepared using such composition.

Another object of the invention is to provide a photoconductive composition containing a binder polymer which does not substantially crystallize and an electrophotographic light-sensitive material using such composition in which adhesion between an electrically conductive layer of a support and a photoconductive composition layer is good, which photoconductive composition layer has good flexibility and film properties.

A further object of the invention is to provide a photoconductive composition and an electrophotographic light-sensitive material having excellent properties as described above by the use of a polyester copolymer which is inexpensive, insoluble in water, amorphous, and has a linear chemical structure.

The present invention, therefore, provides a photoconductive composition comprising a photoconductive substance and a water-insoluble, linear polyester copolymer wherein the polyester copolymer contains a constituent repeating unit derived from terephthalic acid and a straight $\alpha,\omega$-diol component, where the diol component contains at least three compounds selected from the group consisting of ethylene glycol, diethylene glycol, triethylene glycol, 1,3-propanediol, 1,4-butanediol, 1,5-pentanediol, and 1,6-hexanediol, and an electrophotographic light-sensitive material comprising a support in which at least the surface is electrically conductive with a photoconductive composition layer on the support prepared using the above photoconductive composition.

DETAILED DESCRIPTION OF THE INVENTION

Water-insoluble linear polyesters which are used in the invention and which being about the significant benefits or the invention will hereinafter be first explained.

The straight $\alpha,\omega$-diol component which is used to prepare the linear polyesters is a compound selected from the compounds represented by general formula (I) below, i.e., polyethylene oxide (or polyethylene glycol), and the compounds represented by the general formula (2), i.e., an $\alpha,\omega$-alkanediol.

$$HO\text{-}(CH_2CH_2\text{—}O)_n\text{-}H \quad (1)$$

(wherein n is an integer of from 1 to 15)

$$HO\text{—}CH_2\text{—}(CH_2)_m\text{—}CH_2\text{—}OH \quad (2)$$

(wherein m is an integer of from 1 to 8).

Examples of polyethylene glycols represented by general formula (1) include ethylene glycol, diethylene glycol, triethylene glycol, pentaethylene glycol, hexaethylene glycol, octaethylene glycol, nonaethylene glycol, and tetradecaethylene glycol. Of these compounds, ethylene glycol, diethylene glycol, and triethylene glycol are preferred.

Examples of $\alpha,\omega$-alkanediols represented by general formula (2) include 1,3-propanediol, 1,4-butanediol, 1,5-pentanediol, 1,6-hexanediol, 1,7-heptanediol, 1,8-octanediol, 1,9-nonanediol, and 1,10-decanediol. Of these compounds, 1,3-propanediol, 1,4-butanediol, 1,5-pentanediol, and 1,6-hexanediol are preferred.

The constituent repeating unit of the water-in-soluble linear polyester copolymer (copolyester) resulting from the condensation of terephthalic acid and the diol component is represented by general formulae (3), (4) or (5) as set forth below (the terminal group of the copolyester is preferably a hydroxy group):

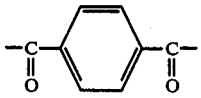

(3)

$$\text{—}O\text{-}(CH_2CH_2\text{—}O)_n \quad (4)$$

(wherein n is an integer of from 1 to about 15)

$$\text{—}O\text{—}CH_2\text{-}(CH_2)_m\text{-}CH_2\text{—}O\text{—} \quad (5)$$

(wherein m is an integer of from 1 to 8).

The linear polyester copolymer has a linear chemical structure and does not substantially contain a branched polyester structure due to a use of only a straight chain diol as the diol component.

The molecular weight of the linear polyester copolymer as used herein is usually from about 2,500 to 70,000 (weight-average molecular weight) and preferably from about 3,000 to 50,000. With regard to the molar proportion of the straight $\alpha,\omega$-diol component, the molar ratio of ethylene glycol/diethylene glycol, 1,3-propanediol or 1,4-butanediol/triethylene glycol, 1,5-pentanediol or 1,6-hexanediol is within the range of (20 to 50)/(2 to 10)/(30 to 70), preferably (30 to 40)/(3 to 5)/(40 to 60). The $\alpha,\omega$-diol component preferably comprises ethylene glycol, diethylene glycol, and triethylene glycol within the molar ratio range of (20 to 50)/(2 to 10)/(30 to 70).

The terephthalic acid used in the preparation of the polyester copolymer of the invention is a terephthalic acid derivative capable of undergoing esterification. Typical examples include terephthalic acid alkyl esters (alkyl moiety having 1 to 8 carbon atoms), e.g., dimethyl terephthalate and diethyl terephthalate; terephthalic anhydride; and terephthalic acid chloride.

The polyester copolymer of the invention can contain, in addition to the above described components, a constituent repeating unit derived from a compound selected from various straight alkylenediols having 2 to 10 carbon atoms and/or bisphenols or a compound selected from monocyclic aromatic diols. The additional compound composing the constituent repeating unit is used in an amount of 5 to 30 mole%, preferably 5 to 20 mole% based on the total amount of diol components.

Typical bisphenols which can be used for the preparation of the polyester copolymer as used herein are represented by the general formula (6) set forth below:

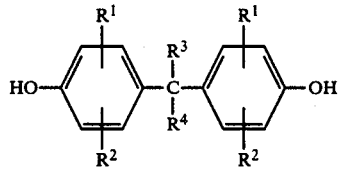

(6)

wherein $R^1$ and $R^2$ may be the same or different, and are each a hydrogen atom, an aryl group, e.g., a phenyl group (including those groups substituted by, for example, a halogen atom, a nitro group, a cyano group or an alkoxy group having 1 to 3 carbon atoms), a halogen atom, a nitro group, a cyano group, an alkoxy group having 1 to 3 carbon atoms or the like; and $R^3$ and $R^4$ represent aliphatic, and monocyclic or dicyclic groups, and are each a hydrogen atom, an alkyl group containing 1 to 6 carbon atoms (including substituted alkyl groups, e.g., a fluoromethyl group, a difluoromethyl group, a trifluoromethyl group, a dichlorofluoromethyl group), a cycloalkyl group containing 4 to 6 carbon atoms, e.g., a cyclohexyl group, or an aromatic group containing 6 to 20 carbon atoms, e.g., a phenyl group, a 3,4-dichlorophenyl group, and a 2,4-dichlorophenyl group. $R^3$ and $R^4$ can form together a monocyclic, dicyclic or heterocyclic portion containing 4 to about 10 atoms selected from the group consisting of C, O, N and S atoms in the ring thereof in combination with a carbon atom.

Examples of useful bisphenols are shown below:

Bisphenol A (i.e., 2,2-bis(4-hydroxyphenyl)-propane), 2,2-bis(4-hydroxy-3,5-dichlorophenyl)propane (tetrachlorobisphenol A), 1-phenyl-1,1-bis(4-hydroxyphenyl)ethane, 1-(3,4-dichlorophenyl)-1,1-bis(4-hydroxyphenyl)ethane, bis(4-hydroxyphenyl)methane, 2,4-dichlorophenyl bis(4-hydroxyphenyl)methane, 1,1-bis(4-hydroxyphenyl)cyclohexane, 1,1,1,3,3,3-hexafluoro-2,2-bis(4-hydroxyphenyl)propane, and diphenylbis(4-hydroxyphenyl)methane.

Other useful bisphenols include 1,4-naphthalenediol, 2,5-naphthalenediol, bis(4-hydroxy-2-methyl-3-propylphenyl)methane, 1,1-bis(2-ethyl-4-hydroxy-5-sec-butylphenyl)ethane, 2,2-bis(4-hydroxyphenyl)propane, 2,2-bis(4-hydroxy-2-methyl-5-tert-butylphenyl)propane, 1,1-bis(4-hydroxy-2-methyl-5-isooctylphenyl)isobutane, and bis(2-ethyl-4-hydroxyphenyl)-4,4-di-p-tolylmethane. In addition, other useful bisphenols are disclosed in U.S. Pat. No. 3,030,335 and Canadian Pat. No. 576,491.

Typical monocyclic aromatic diols are hydroquinone, hydroquinone substituted by an alkyl group containing from 1 to about 15 carbon atoms or a halogen atom, resorcinol, and resorcinol substituted by a lower alkyl group having 1 to 5 carbon atoms, a halogen atom or the like.

The polyester copolymer used herein should be such that the carboxylic acid group contained in the terephthalic acid component for use in the preparation thereof is substantially completely absent. However, in practice, one of the advantages of the electrophotographic light-sensitive material of the invention resides resides in the use of a linear polyester copolymer in which the acid functional group is substantially absent. It has been found that the presence of the acid functional group exerts an adverse influence on the photoconductive composition, particularly on the electrical properties of the organic photoconductive composition. Although the exact reason for that is not yet clear, it is believed that the acid functional group interacts with, e.g., an organic photoconductive substance, causing electrical fatigue of the photoconductive substance.

The polyester copolymer as used herein is amorphous, i.e., a polymer which does not exhibit any transition in melting point or does not show a definite X-ray diffraction pattern. Furthermore, it is a random copolymer. The polyester copolymer as used herein shows good film-forming properties and does not have crystallinity.

Since it is preferred, as described hereinbefore, to use a polyester copolymer which is completely esterified, the terephthalic acid and diol components are used in essentially equal molar amounts. In practice, a slight excess or shortage of the terephthalic acid or diol components within the range of 5 mole % based on the calculated equal molar amount may be used. However, it is best to use slight excess of the diol component in order to achieve complete esterification, or alternatively, in order to produce such substantially or completely esterified polyesters, various conventional purification or separation processes are applied after the production of the desired polyester copolymer.

Polyester copolymers which are preferred to use in the invention have a molecular weight of greater than about 2,500, preferably greater than about 3,000 so that optimum physical properties are obtained, and in order that they are soluble in the conventional organic solvents, e.g., chlorinated hydrocarbon solvents such as methylene chloride, chloroform and dichloroethane, have molecular weights of about 70,000 or less, preferably about 50,000 or less. These polyester copolymers are insoluble in water, do not easily crystallize and are substantially amorphous.

As described hereinbefore, the polyester copolymer as used herein is used as a component for the photoconductive composition of the electrophotographic light-sensitive material, or is used to form an independent polymeric intermediate layer which is to be interposed between the electrically conductive support and the photoconductive composition layer. In the former case where the polyester copolymer is used as a component for the photoconductive composition, it is typically used in not greater amounts than the polymeric binder contained in the photoconductive composition. Typically, therefore, the polyester copolymer is used within the range of from about 1 to 50% by weight based on the total weight of the polymeric binder in the photoconductive composition.

In a preferred embodiment of the invention, the amount of the polyester copolymer in the photoconductive composition is preferably from about 2 to 20% by weight based on the total weight of the polymeric binder used in the photoconductive composition. In general, the total weight of the polyester component contained in a typical photoconductive composition for an electrophotographic light-sensitive material of the invention is within the range of from about 0.25 to 30% by weight, preferably from about 1.0 to 20% by weight based on the total weight of all components, when dried, in the photoconductive composition. The term "% by weight" is used herein to refer to a "percent by weight" based on the dry weight of a specific composition which under consideration. This, therefore, excludes the amounts of the solvent and dispersing medium as used in a conventional coating solution.

As indicated hereinbefore, the polyester copolymer as used herein possesses specific usefulness as a minor component for the organic photoconductive composition. Incorporation of a minor amount of the polyester copolymer into the organic photoconductive composition permits to remove the harmful effects in the electric handling properties of the organic photoconductive composition. The "electric handling property" means resistivity of photoconductive composition against repetition of procedures of applying electric charge and discharge. This is a particularly significant advantage. The reason for this is that although many polymeric substances possess useful electrically insulative properties and film-forming properties, polymeric substances bring about harmful effects in the electric handling properties of a composition containing such a polymeric substance and, therefore, they are not suitable for use alone in an organic photoconductive composition. Furthermore, it has been found that the polyester copolymer of the invention provides an organic photoconductive composition with good adhesion properties compared with polyesters similar thereto, e.g., a copolyester of terephthalic acid, 2,5-dichloroterephthalic acid, and ethylene glycol, or a copolyester of terephthalic acid, 2,2-bis[4-($\beta$-hydroxyethoxy)phenyl]propane, and ethylene glycol.

Where the polyester copolymer as used herein is used to form an intermediate layer (or subbing layer) for an electrophotographic light-sensitive material, the intermediate layer is placed between an electrically conductive layer, such as an electrically conductive support, and the photoconductive composition layer. In addition, if necessary, a suitable electric barrier layer having preferably 0.1$\mu$ to 1$\mu$ thickness can be provided in the electrophotographic light-sensitive material. A copolymer of vinyl acetate and vinyl chloride, a nitrocellulose, a nitrile-rubber, etc. are preferably used as the barrier layer. When the barrier layer is provided in the electrophotographic light-sensitive material, it is typically placed between the electrically conductive support of the invention and the intermediate layer containing the polyester copolymer.

In the above case where the polyester copolymer is used to form an independent intermediate layer for the electrophotographic light-sensitive material, it is preferred to reduce the thickness of the intermediate layer so as not to substantially prevent the necessary electric contact between the photoconductive composition which is above the intermediate layer and the electrically conductive support which is below the intermediate layer. Typically, the dry thickness of the intermediate layer is from about 0.1 to 0.5 μm. In a preferred embodiment of the invention, it has been found that the polyester copolymer as used herein provides an intermediate (or subbing layer) having particularly good adhesion properties. These polyester copolymers are particularly useful since they permit one to avoid harmful chemical or other interactions with the photoconductive substance which exert an adverse influence on the electrical handling properties of the electrophotographic light-sensitive material. In preparing the independent intermediate layer, the polyester copolymer is dissolved or dispersed in a liquid solvent, e.g., a volatile organic solvent or a dispersing medium, such as an ethylene chloride, a methylene chloride, a methyl ethyl ketone, and is coated by a conventional coating technique. Since these coating techniques are well known and are not subject to any special limitations in this invention, detailed explanation on for the coating techniques is omitted.

Supports with an electrically conductive surface which can be used for the electrophotographic light-sensitive material of the invention include a wide variety of electrically conductive supports, preferably having not more than $10^9$ ohm, such as paper (having a relative humidity of at least 20%), an aluminum/paper laminate, a metal foil (e.g., an aluminum foil or a zinc foil), a metallic plate (e.g., aluminum, copper, zinc, brass and zinc-plated plates), and supports comprising conventional photographic film bases, e.g., paper, cellulose acetate, polystyrene, and polyethylene terephthalate and vacuum-deposited metal coated e.g., silver, nickel, chromium, aluminum, or vacuum deposited electrically conductive compound layers, e.g., $SnO_2$, $In_2O_3$ or the like coated thereon. Since electrically conductive materials such as nickel $SnO_2$ and $In_2O_3$ can be vacuum deposited on a transparent film support as a thin layer, an electrophotographic light-sensitive layer prepared using such materials can be exposed to light through the transparent film support. Particularly useful electrically conductive support can be prepared by coating electrically conductive layers prepared by dispersing electrically conductive compounds (e.g., $SnO_2$ and $In_2O_3$) or metallic powder in a solvent, onto a support material such as polyethylene terephthalate. These electrically conductive layers—free of or having an electrical barrier layer—are described in U.S. Pat. No. 3,245,833 issued Apr. 12, 1966 and U.S. Pat. No. 2,901,348 issued Aug. 25, 1959.

Other useful electrically conductive layers include those prepared by the vacuum deposition of compositions consisting substantially of at least one protective inorganic oxide and from about 30 to 70% by weight of at least one electrically conductive metal based on the weight of electrically conductive layer, for example, electrically conductive layers prepared by the vacuum deposition of cermets as are disclosed in U.S. Pat. No. 3,880,657 issued Apr. 29, 1975. Similarly, a suitable electrically conductive coated product can be prepared using the sodium salt of carboxy ester lactone of maleic anhydride and a vinyl acetate polymer. Electrically conductive layers of that type, and optimum methods of production and use thereof, are disclosed in U.S. Pat. No. 3,007,901 issued Nov. 7, 1961 and U.S. Pat. No. 3,262,807 issued July 26, 1966.

The photoconductive composition for use in the electrophotographic light-sensitive material of the invention preferably comprises a photoconductive substance and an electrically insulative, film-forming binder substance. Such photoconductive substances include a wide variety of organic and inorganic photoconductive substances (including organometallic compounds). The photoconductive composition can contain various sensitizing materials such as spectral sensitizing dyes and chemical sensitizers. In general, a typical photoconductive composition of the invention contains the photoconductive substance in the amount of at least 1% by weight based on the total weight of the photoconductive composition in the state that it is dried. Preferably the photoconductive substance is contained in the amount of at least about 15% by weight based on the total weight of the photoconductive composition.

The upper limit of the amount of the photoconductive substance is a given photoconductive composition varies in a wide range depending on the compatibility of the sensitivity of the photoconductor with the specific binder component. When a polymeric photoconductive substance is used as a photoconductor, the photoconductive composition can be composed of the polymerous photoconductive substance alone since it functions as a binder because of its polymeric properties. In many cases, however, it is desirable to incorporate a specially selected binder into the photoconductive composition in order to provide useful electrically insulative properties and film-forming properties even in the case of using polymeric photoconductive substances in the photoconductive composition for the electrophotoconductive light-sensitive material of the invention. The amount of the polymeric binder component used is within the range of from about 85 to 10% by weight based on the total weight of the photoconductive composition in the dry state.

A wide variety of photoconductors including inorganic, organic and organic polymeric photoconductive substances (including organometallic compounds) can be used in the photoconductive composition of the invention. Since these compounds are well known in the art, only typical examples are given below:

Zinc oxide, lead oxide, granular organic pigments, e.g., phthalocyanine pigment, and organic compounds including organometallic compounds as polymeric organic photoconductors.

Examples of such photoconductive substances are described in the report titled *Electrophotographic Elements, Materials and Processes,* appearing in *Research Disclosure,* Vol. 109, page 61, May 1973.

Photoconductive substances which are preferably used in the invention are polymeric organic photoconductive substances containing a polycyclic or heterocyclic aromatic ring. These polymeric organic photoconductors containing a polycyclic or heterocyclic aromatic ring are vinyl polymer type polymers containing a $\pi$ electron system in the main or side chain thereof.

Typical $\pi$ electron systems contained in polymeric organic photoconductors include polycyclic aromatic hydrocarbons, such as naphthalene, anthrathene, pyrene, perylene, acenaphthene, phenylanthrathene, and diphenylanthrathene, heterocyclic aromatic compounds, such as carbazole, indole, acridine, 2-phenylindole, and N-phenylcarbazole, and their halogen or lower alkyl having 1 to 5 carbon atoms-substituted derivatives. Representative examples are given below:

Polymers or copolymers such as vinyl polymers, e.g., polyvinyl naphthalene, polyvinyl anthrathene, polyvinyl pyrene, polyvinyl perylene, polyacenaphthylene, polystyryl anthrathene, polyvinyl carbazole, polyvinyl indole and polyvinyl acridine; vinyl copolymers, e.g., copolymers obtained by the reaction between methyl methacrylate, methyl acrylate or acrylamide and at least one of the above described vinyl compounds; vinyl ether polymers, e.g., polyanthryl methylvinyl ether, polypyrenyl methylvinyl ether, polycarbazolyl ethylvinyl ether, and polyindolyl ethylvinyl ether; epoxy resins, e.g., polyglycidyl carbazole, polyglycidyl indole, and poly-p-glycidyl anthrylbenzene; polyacrylates or polymethacrylates containing a $\pi$ electron system as described above as a substitution group; and condensation polymers of the above described $\pi$ electron system compounds and formaldehyde.

Of these compounds, poly-N-vinyl carbazole and poly-N-vinyl carbazoles substituted on a carbazole ring by, for example, an aryl group having 6 to 12 carbon atoms, an alkaryl group having 7 to 20 carbon atoms, an amino group, an alkylamino group having 1 to 10 carbon atoms, a dialkylamino group having 2 to 10 carbon atoms, an arylamino group having 6 to 12 carbon atoms, a diarylamino group having 12 to 18 carbon atoms, a N-alkyl-N-arylamino group alkyl group having 1 to 10 carbon atoms and aryl group having 6 to 12 carbon atoms, a nitro group, and a halogen atom (these poly-N-vinyl carbazoles are hereinafter referred to as "substituted poly-N-vinyl carbazoles), and N-vinyl carbazole copolymers are preferred.

N-vinylcarbazole copolymers which can be used contain at least 50 mole % of the N-ethylene carbazole constituent repeating unit represented by the general formula (7):

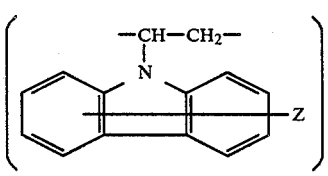

(7)

wherein Z represents the same substituent as described for the above described substituted poly-N-vinyl carbazoles.

Constituent repeating units forming the N-vinyl carbazole copolymers other than the N-vinyl carbazole constituent repeating unit include 1-phenylethylene, 1-cyanoethylene, 1-cyano-1-methylethylene, 1-chloroethylene, 1-(alkoxycarbonyl)ethylene, and 1-alkoxycarbonyl-1-methylethylene, which are derived from styrene, acrylonitrile, methacrylonitrile, vinyl chloride, alkyl acrylate, and alkyl methacrylate, respectively, and in which as the alkyl group for the alkoxycarbonyl group, an alkyl group containing from 1 to 18 carbon atoms, e.g., a methyl group, an ethyl group, a hexyl group, a dodecyl group, an octadecyl group, and a 4-methylcyclohexyl group, can be used.

The photoconductive composition of the invention can be used in a conventional manner; that is, a dispersion or solution of the photoconductive substance is mixed with a binder and coated on the electrically conductive layer to form the photoconductive composition layer.

The photoconductive composition of the invention can be sensitized by adding conventional sensitizers in an effective amount(s) to provide improved electrophotographic sensitivity. Sensitizing compounds which are useful for various photoconductive compositions can be selected, e.g., from the following compounds:

Various pyrylium dye salts as described in U.S. Pat. No. 3,250,615, e.g., pyrylium, bispyrylium, thiapyrylium and selenapyrylium dye salts, 2,6-di-tert-butylthiapyrylium dye salts as described in Japanese Patent Applications (OPI) Nos. 129283/80, 14560/81, Japanese Patent Applications Nos. 105547/79, 114259/80, etc., fluorenes, e.g., 7,12-dioxo-13-dibenzo(a,h)-fluorene, aromatic nitro compounds as described in U.S. Pat. No. 2,610,120, anthrones as described in U.S. Pat. 2,670,284, quinones as described in U.S. Pat. No. 2,670,286, benzophenones, e.g., those as described in U.S. Pat. No. 2,670,287, thiazoles, e.g., those as described in U.S. Pat. No. 3,732,301, cyanine (including carbocyanine), merocyanine, diarylmethane, thiazine, azine, oxazine, xathene, phthalein, acridine, and azoanthraquinone dyes, and mixtures thereof.

In adding such sensitizing compounds to the photoconductive composition of the invention, they are usually mixed with coating compositions. In accordance with this method, the sensitizing compounds is distributed uniformly in the resulting coating layer. Other methods of adding the sensitizing compound can be used in the practice of the invention. Of course, it is not necessary to sensitize a layer in which the specific photoconductive substance used shows sufficient sensitivity in a given spectral region without a sensitizer. Addition of the sensitizing compound within the concentration range of from about 0.001 to 30% by weight, preferably from about 0.005 to 10% by weight, based on the dry weight of the photoconductive composition increases the sensitivity, although the optimum concentration varies depending on the types of the photoconductive compound and sensitizing compound used.

Of various binders which can be used in the photoconductive composition of the invention, film-forming, hydrophobic polymeric substances having a high dielectric breakdown strength and good electrical insulating properties are preferred for use.

Typical examples of such substances are as follows:

(I) Natural Resins

Gelatin, cellulose ester derivatives, e.g., alkyl esters of carboxylate cellulose, hydroxyethyl cellulose, carboxymethyl cellulose, carboxymethyl hydroxyethyl cellulose, etc.

(II) Vinyl Resins (a) Polyvinyl esters, e.g., a vinyl acetate resin, copolymers of vinyl acetate and esters of vinyl alcohols and higher aliphatic carboxylic acids (e.g., lauric acid and stearic acid), polyvinyl stearate, polyvinyl halobenzoates (e.g., copolymer of vinyl m-bromobenzoate and vinyl acetate), and a terpolymer of vinyl butyral, vinyl alcohol and vinyl acetate.

(b) Styrene polymers, e.g., polystyrene, nitrated polystyrene, a copolymer of styrene and monoisobutyl maleate, a copolymer of styrene and butadiene, a copolymer of dimethyl itaconate and styrene, polymethyl styrene, etc.

(c) Methacrylate polymers, e.g., polyalkyl methacrylate, etc.

(d) Polyolefins, e.g., chlorinated polyethylene, chlorinated polypropylene, polyisobutylene, etc.

(e) Polyvinyl acetals, e.g., polyvinyl butyral, etc.

(f) Polyvinyl alcohol (III) Polycondensation Products (a) A copolyester of 1,3-disulfobenzene and 2,2-bis(4-hydroxyphenyl)propane (b) A polyester of diphenyl-p,p'-disulfonic acid and 2,2-bis(4-hydroxyphenyl)propane (c) A polyester of 4,4'-carboxyphenyl ether and 2,2-bis(4-hydroxyphenyl)propane (d) A polyester of 2,2-bis(4-hydroxyphenyl)propane and fumaric acid (e) A polyester of phosphoric acid and hydroquinone (f) Polycarbonates and polythiocarbonates, e.g., polycarbonate of 2,2-bis(4-hydroxyphenyl)propane (g) A copolyester of isophthalic acid, 2,2-bis(4-(β-hydroxyethoxy)phenyl]propane and ethylene glycol (h) A copolyester of terephthalic acid, 2,2-bis[4-(β-hydroxyethoxy)phenyl]propane and ethylene glycol (i) Polyamides (j) Ketone resins (k) A phenol-formaldehyde resin (IV) Silicone Resins (V) Alkyd Resins A styrene-alkyd resin, a silicone alkyd resin, etc.

(VI) Paraffins (VII) Mineral Wax

Various known solvents can be used as solvents or dispersing media for the preparation of the photoconductive composition of the invention. It has been found that volatile organic solvents are very effective. Typical examples of such solvents include aromatic hydrocarbons, e.g., benzene, substituted aromatic hydrocarbons, e.g., toluene, xylene, and mesitylene, ketones, e.g., acetone, and 2-butanone, halogenated aliphatic hydrocarbons, e.g., methylene chloride, chloroform, and ethylene chloride, ethers and cyclic ethers, e.g., tetrahydrofuran, methyl ethyl ether, and ethyl ether, and mixtures thereof.

In a particularly preferred embodiment of the invention, the photoconductive composition for use in the electrophotographic light-sensitive material of the invention is a homogeneous organic photoconductive composition containing an electrically insulating, film-forming polymeric binder and an organic photoconductor in the binder in the state of a solid solution. One or more sensitizing compounds, for example, one of pyrylium, bispyrylium, thiapyrylium, and selenapyrylium can be added. The photoconductive composition can be coated with ease using an organic solvent. The use of suitable sensitizing compound permits the material to exhibit light sensitivity within the desired effective range. The photoconductive composition provides a visible image of high resolving power because of its optical uniformity. Organic photoconductive substances which can be used to the photconductive composition include those organic substances described in the above described *Research Disclosure,* IV (A) (2) to IV (A) (12).

In the present invention, multi-layer type photoconductive layer comprising an electric charge transfer layer and an agglegation electric charge generating layer may be prepared as the photoconductive composition layer. The polyester copolymer of the present invention may be incorporated into any layer of multi-layer type photoconductive layer above described, preferably into the agglegation circuit charge generating layer.

Where the polyester copolymer is incorporated into the photoconductive composition layer, the layer has 0.1μ to 110μ, preferably, 1μ to 30μ, preferably 3μ to 20μ thickness. In the multi-layer type electrographic light-sensitive material, the electric charge transfer layer has preferably 0.1μ to 10μ thickness, the agglegation electric charge generating layer has preferably 1μ to 100μ thickness. The support for the electrophotographic light-sensitive material has 30μ to 200μ thickness. The following examples are givin to illustrate the invention in greater detail.

EXAMPLES 1 TO 9

A solution of 10 g of poly-N-vinyl carbazole (PVCz) [3=0.48 (in ethylene chloride, 20° C.)] dissolved in 100 ml of 1,2-dichloroethane was prepared, and 0.25 g of 2,6-di-tert-butyl-4-[4-(N-methyl-N-cyanoethylamino)-styryl)thiapyrylium]tetrafluoroborate was added thereto to prepare a photoconductive composition solution. This solution was coated on a 18 μm thick polyethylene terephthalate (PET) film with $In_2O_3$ vapor deposited thereon and, thereafter, the solvent was removed by drying to form a 5 μm thick photoconductive composition layer. In this way, an electrophotographic film No. 1 (comparative example) was prepared.

To a portion of the above prepared solution was added each of the linear polyester copolymers shown in Table 1 in the amount (per 100 parts by weight of PVCz) indicated in Table 1 to prepare a photoconductive composition solution. This solution was coated on the same electrically conductive PET film as used above in the same manner as above, and dried to remove the solvent. In this way, electrophotographic films Nos. 2 to 9, each provided with a 5 μm thick photographic composition layer, were prepared.

For these electrophotographic films Nos. 1 to 9, flexibility was tested according to the W.B.T. method. The results are shown in Table 1. The smaller the value, the lesser the film cracking, i.e., flexibility is higher.

Electrophotographic properties were examined as follows:

Each electrophotographic film was charged in the dark by the use of a corona charging apparatus so that the positive potential of the photoconductive composition layer was 550 V and, thereafter, was allowed to stand in the dark. Surface potential was measured to evaluate the dark charge retention force (i.e., dark decay resistivity) after 10 seconds and 70 after seconds. When the surface potential reached 500 V, the photoconductive composition layer was irradiated with monochromatic light of wave length of 630 nm (Intensity $I_O$ erg), and the time Δt seconds) required for the surface potential to decrease to 250 V was measured to evaluate the sensitivity ($E_{50}$). Finally, 20 seconds after the irradiation with monochromatic light, the residual potential of the surface was measured.

The dark charge retention force and sensitivity were calculated by the following equations:

$$\text{Dark charge retention force} = \frac{\text{Surface Potential after 70 seconds}}{\text{Surface Potential after 10 seconds}} \times 100\ (\%)$$

$$\text{Sensitivity } (E_O) = I_O \times \Delta t (\text{erg/cm}^2)$$

The results are shown in Table 1.

TABLE 1

| | Comparative Example | Examples | | | | | | | |
|---|---|---|---|---|---|---|---|---|---|
| | 1 | 2 | 3 | 4 | 5 | 6 | 7 | 8 | 9 |
| Linear Polyester Copolymer | not contained | | | | | | | | |
| Terephthalic Acid (molar) | | 100 | 100 | 100 | 100 | 100 | 100 | 100 | 100 |
| Diol Component (molar) | | | | | | | | | |
| Ethylene Glycol | | 52 | 52 | 27 | 27 | 52 | 52 | 26 | 26 |
| Diethylene Glycol | | 3 | 3 | 3 | 3 | 4 | 4 | 4 | 4 |
| Triethylene Glycol | | 45 | 45 | 60 | 60 | 44 | 44 | 55 | 55 |
| Bisphenol A-Ethylene Oxide Adduct | | not present | not present | 10 | 10 | not present | not present | 15 | 15 |
| Amount (wt %, per 100 parts by weight of PVCz) | not contained | 2 | 5 | 2 | 5 | 2 | 5 | 2 | 5 |
| W.B.T. Method | 5 | 3 | no cracking | 2 | no cracking | 3 | no cracking | 2 | no cracking |
| Charge Retention Force (%) | 85 | 90 | 91 | 87 | 88 | 90 | 91 | 88 | 88 |
| Sensitivity ($E_{50}$) (erg/cm$^2$) | 100 | 115 | 125 | 120 | 138 | 108 | 120 | 121 | 129 |
| Residual Potential (V) | 20 | 22 | 20 | 20 | 23 | 20 | 22 | 20 | 24 |

It can be seen from Table 1 that the addition of a small amount of the linear polyester copolymer markedly increased the film strength without any adverse influence on electrophotographic properties.

EXAMPLE 10

In this example, three function separation type (multi-layer type) electrophotographic light-sensitive materials were prepared. In each multi-layer type material, a 2 μm thick (dry thickness) agglegation electric charge-generating layer was coated on a vacuum deposited nickel layer having an optical density of 0.4 which was provided on a PET film. On the agglegation electric charge-generating layer, there was provided a 14 μm thick (dry thickness) electric charge transfer layer.

The agglegation electric charge generating layer was prepared in the same manner as described in Example 6 of U.S. Pat. No. 3,615,415 issued Oct. 26, 1971. That is, a small portion (i.e. about 270 parts by weight) of an organic solvent coating solution as defined hereinafter was first stirred for 2 hours by the use of a Waring blender. This preliminarily blended portion was added to the remaining agglegation coating solution, and the resulting mixture was further stirred for a short period of time and then coated on the nickel electrically conductive layer on the support.

The organic solvent coating solution which was used to form the agglegation electric charge-generating layer had the following formulation:

| | |
|---|---|
| High polymer polycarbonate (polycarbonate prepared from diphenyl carbonate and 2,2-bis(4-hydroxydiphenyl) propane by the ester exchange method, Molecular Weight 50,000 to 60,000) | 27 parts by weight |
| 4-(4-Dimethylaminophenyl)-2,6-diphenylthiapyrylium hexafluorophosphate | 3.9 parts by weight |
| Tritolylamine | 18.8 parts by weight |

-continued

| | |
|---|---|
| (organic photoconductive electric charge transfer substance) | |
| Dichloromethane (solvent) | 952 parts by weight |
| 1,1,2-Trichloroethane (solvent) | 685 parts by weight |

The electric charge transfer layer was prepared by coating an organic solvent coating solution having the following formulation:

| | |
|---|---|
| Lexan 145 Polycarbonate (made by General Electric Co.) (polycarbonate of medium molecular weight) | 180 parts by weight |
| Tritolylamine (organic photoconductive electric charge transfer substance) | 120 parts by weight |
| Chloroform (solvent) | 1,700 parts by weight |

The single difference between the three different materials formed was as follows. For the two multi-layer type electrophotographic light-sensitive materials of the invention, 2.7 parts by weight of polyester copolymers (the same as used in Examples 2 and 3) were present in the above described organic solvent solution for the preparation of the agglegation electric charge-generating layer. On the other hand, in the case of the other multi-layer material (comparative example), no polyester copolymer was present in the coating solution for the agglegation electron-generating layer.

It was found that the agglegation electric charge-generating layer of the material of comparative example was greatly inferior in adhesion properties to the electrically conductive nickel layer as compared to the materials of the invention.

EXAMPLE 11

Several multi-layer type electrophotographic light-sensitive materials were prepared by the same method as described in Example 10. In these materials, however, the electric charge-generating layer contained a perchrolate salt in place of the thiapyrylium salt (the amount being the same) and was free of tritolylamine. Furthermore, no polyester copolymer was used in the electric charge-generating layer.

In comparative materials, an adhesive subbing layer composed of a methyl acrylate/vinylidene chloride/itaconic copolymer was provided between the nickel electrically conductive layer and the agglegation electric charge-generating layer. On the other hand, in the case of multi-layer materials per the invention, a polyester copolymer as used in Examples 4 and 5 was used as an intermediate layer having 0.3 μm thickness between the nickel electrically conductive layer and the agglegation electric charge-generating layer.

Each multi-layer material was subjected to a series of continuous electrophotographic image-forming steps (comprising a step of applying a negative uniform surface electric charge and exposure to radiation to discharge the material). It was found that the electric fatigue of the comparative material was very high as compared with the materials of the invention.

This example demonstrates one of the features of the invention, i.e., that the polyester copolymer of the invention does not exert any adverse influence on the electric handling properties of the electrophotographic light-sensitive material. Furthermore, it is apparent that the typical undercoating material which has hereto been known produces an undesirable "electrical fatigue" effect.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support, at least the surface thereof being electrically conductive, and a photoconductive composition layer on the support, said photoconductive composition comprising a photoconductive substance which is an organic photoconductor and a water-insoluble linear polyester copolymer, wherein said polyester copolymer contains a constituent repeating unit derived from terephthalic acid and a straight chain α,ω diol-component, and said diol component contains at least three compounds selected from the group consisting of ethylene glycol, diethylene glycol, triethylene glycol, 1,3-propanediol, 1,4-butanediol, 1,5-pentanediol, and 1,6-hexanediol.

2. The electrophotographic light-sensitive material as claimed in claim 1, wherein the polyester copolymer has a molecular weight of from about 3,000 to 50,000.

3. The electrophotographic light-sensitive material as claimed in claim 1, wherein the proportion of the polyester copolymer is in the range of from about 0.25 to 30% by weight based on the total dry weight of the photoconductive composition.

4. The electrophotographic light-sensitive material as claimed in claim 1, wherein an intermediate layer containing the polyester copolymer is provided between the support and the photoconductive composition layer.

5. The electrophotographic light-sensitive material as claimed in claim 1, wherein the diol component contains at least three compounds selected from (a) ethylene glycol, (b) diethylene glycol, 1,3-propanediol and/or 1,4-butanediol and (c) triethylene glycol, 1,5-pentanediol and/or 1,6-hexanediol.

6. The electrophotographic light-sensitive material as claimed in claim 5, wherein the molar ratio of component (a): component (b): component (c) is 20 to 50:2 to 10:30 to 70.

7. The electrophotographic light-sensitive material as claimed in claim 1, wherein the photoconductive composition layer is one layer.

8. An electrophotographic light-sensitive material comprising a support, at least the surface thereof being electrically conductive, an intermediate layer containing a water-insoluble linear polyester copolymer and a photoconductive composition layer comprising a photoconductive substance which is an organic photoconductor, wherein said polyester copolymer contains a constituent repeating unit derived from terephthalic acid and a straight chain α,ω-diol component, and said diol component contains at least three compounds selected from the group consisting of ethylene glycol, diethylene glycol, triethylene glycol, 1,3-propanediol, 1,4-butanediol, 1,5-pentanediol, and 1,6-hexanediol.

9. The electrophotographic light-sensitive material as claimed in claim 8, wherein the polyester copolymer has a molecular weight of from about 3,000 to 50,000.

10. The electrophotographic light-sensitive material as claimed in claim 9, wherein the proportion of the polyester copolymer is in the range of from about 0.25 to 30 by weight based on the total dry weight of the photoconductive composition.

11. The electrophotographic light-sensitive material as claimed in claim 9, wherein the diol component contains at least three compounds selected from (a) ethylene glycol, (b) diethylene glycol, 1,3-propanediol and/or 1,4-butanediol and (c) triethylene glycol, 1,5-pentanediol and/or 1,6-hexanediol.

12. The electrophotographic light-sensitive material as claimed in claim 11, wherein the molar ratio of component (a): component (b): component (c) is 20 to 50:2 to 10:30 to 70.

* * * * *